US011185121B2

(12) United States Patent
Aveni et al.

(10) Patent No.: US 11,185,121 B2
(45) Date of Patent: Nov. 30, 2021

(54) FOOTWEAR ARTICLE HAVING CORD STRUCTURE

(71) Applicant: Fuerst Group, Inc., Menlo Park, CA (US)

(72) Inventors: Michael A. Aveni, Lake Oswego, OR (US); John Tawney, Portland, OR (US); Rory Fuerst, Portland, OR (US)

(73) Assignee: Fuerst Group, Inc., Menlo Park, CA (US)

( * ) Notice: Subject to any disclaimer, the term of this patent is extended or adjusted under 35 U.S.C. 154(b) by 251 days.

(21) Appl. No.: 16/108,036

(22) Filed: Aug. 21, 2018

(65) Prior Publication Data

US 2018/0352892 A1 Dec. 13, 2018

Related U.S. Application Data

(62) Division of application No. 14/076,007, filed on Nov. 8, 2013, now Pat. No. 10,092,060.

(Continued)

(51) Int. Cl.

*A43B 1/04* (2006.01)
*A43C 1/04* (2006.01)

(Continued)

(52) U.S. Cl.

CPC ..... *A43B 3/122* (2013.01); *A43B 1/04* (2013.01); *A43B 3/126* (2013.01); *A43B 3/128* (2013.01); *A43B 3/22* (2013.01); *A43B 23/0295* (2013.01); *A43B 23/088* (2013.01); *A43C 1/00* (2013.01); *A43C 1/04* (2013.01); *A43C 1/06* (2013.01); *A43C 9/08* (2013.01); *D04B 1/22* (2013.01); *D04B 5/00* (2013.01); *D10B 2501/043* (2013.01)

(58) Field of Classification Search

CPC ..... A43B 1/04; A43B 3/122; A43B 3/128; A43B 3/126; A43B 23/0295; A43C 1/00; A43C 1/04; A43C 1/06; A43C 9/08

USPC ..... 36/83, 105

See application file for complete search history.

(56) References Cited

U.S. PATENT DOCUMENTS 687,513 A * 11/1901 Bibikov ..... A43B 3/126 36/11.5
1,600,621 A * 9/1926 Buek, Jr. ..... A43B 1/02 12/142 V (Continued)

FOREIGN PATENT DOCUMENTS

CH 132292 A 4/1929
FR 616246 A 1/1927

(Continued)

OTHER PUBLICATIONS

ISA Korean Intellectual Property Office, International Search Report and Written Opinion of PCT/US2013/06931, dated Feb. 11, 2014, WIPO, 11 pages.

(Continued)

*Primary Examiner* — Katharine G Kane
(74) *Attorney, Agent, or Firm* — McCoy Russell LLP

(57) ABSTRACT

A footwear article is provided herein. The footwear article may include a sole coupled to a cord structure. The cord structure may include interconnected bights in a vamp cord and a rand cord forming a loop line extending along at least a portion of the footwear article.

10 Claims, 14 Drawing Sheets

Related U.S. Application Data

(60) Provisional application No. 61/724,797, filed on Nov. 9, 2012.

(51) Int. Cl.

| | |
|---|---|
| ***A43B 1/12*** | (2006.01) |
| ***A43B 23/02*** | (2006.01) |
| ***D04B 1/22*** | (2006.01) |
| ***A43B 3/12*** | (2006.01) |
| ***A43B 3/22*** | (2006.01) |
| ***A43C 9/08*** | (2006.01) |
| ***A43C 1/06*** | (2006.01) |
| ***A43B 23/08*** | (2006.01) |
| ***A43C 1/00*** | (2006.01) |
| ***D04B 5/00*** | (2006.01) |

(56) References Cited

U.S. PATENT DOCUMENTS 1,877,080 A * 9/1932 Teshima ..... D04B 1/22 36/7.5
D91,999 S * 4/1934 Heilbrunn ..... D2/918
D95,204 S * 4/1935 Haflin ..... D2/931
RE21,392 E * 3/1940 Hurwit ..... A43B 1/04 36/3 A
2,551,723 A * 5/1951 Cesar ..... A43B 3/126 36/11.5
D164,847 S * 10/1951 Dronoff ..... A43B 23/0295 D2/971
2,675,631 A * 4/1954 Doughty ..... A43B 1/04 36/12
3,067,532 A * 12/1962 Peterson ..... A43B 3/108 36/22 R
3,193,943 A 7/1965 Roberts
3,193,948 A * 7/1965 Roberts ..... A43B 23/0255 156/166
3,471,948 A 10/1969 Nadler
D278,947 S * 5/1985 Foldes ..... A43B 3/108 D2/940
D351,275 S 10/1994 Hatfield et al.
5,692,319 A 12/1997 Parker et al.
D391,068 S * 2/1998 Aveni ..... A43B 1/04 D2/906
D393,360 S * 4/1998 Aveni ..... A43B 23/0295 D2/972
6,029,376 A * 2/2000 Cass ..... A43C 1/04 36/50.1
6,052,921 A * 4/2000 Oreck ..... A43C 1/00 36/50.1
6,440,879 B1 9/2002 Fallon et al.
6,449,879 B1 * 9/2002 Fallon ..... A43B 23/26 36/128
D467,723 S * 12/2002 Gerber ..... D2/972
7,204,042 B2 * 4/2007 Aveni ..... A43B 7/08 36/45
7,293,371 B2 * 11/2007 Aveni ..... A43B 7/08 36/45
7,540,097 B2 * 6/2009 Greene ..... A43B 9/00 36/3 A
7,703,220 B2 4/2010 Aveni
7,774,884 B2 8/2010 Greene et al.
8,051,581 B2 * 11/2011 Aveni ..... A43B 3/06 12/142 T
8,065,818 B2 * 11/2011 Greene ..... A43B 9/00 36/45
2005/0055844 A1 * 3/2005 Yu ..... A43B 1/0036 36/19 R
2006/0059715 A1 * 3/2006 Aveni ..... A43B 7/08 36/45
2007/0180730 A1 * 8/2007 Greene ..... A43B 9/00 36/3 A
2008/0083137 A1 4/2008 Aveni
2008/0289214 A1 * 11/2008 Aveni ..... A43B 3/06 36/11.5
2009/0071041 A1 * 3/2009 Hooper ..... A43B 7/06 36/3 A
2010/0107346 A1 * 5/2010 Aveni ..... A43B 1/0027 12/146 R
2010/0107442 A1 * 5/2010 Hope ..... A43B 23/024 36/50.1
2010/0154256 A1 * 6/2010 Dua ..... A43B 1/04 36/25 R
2011/0041359 A1 * 2/2011 Dojan ..... A43B 23/025 36/47
2012/0017468 A1 * 1/2012 Dojan ..... A43B 3/26 36/47
2012/0066931 A1 3/2012 Dojan et al.
2012/0246973 A1 * 10/2012 Dua ..... A43B 23/0235 36/83
2017/0202296 A1 7/2017 Fuerst, Jr. et al.

FOREIGN PATENT DOCUMENTS

| | | | |
|---|---|---|---|
| FR | 1027754 | A | 5/1953 |
| FR | 1055620 | A | 2/1954 |
| JP | 3038372 | U | 6/1997 |
| KR | 1998068775 | U | 12/1998 |
| NL | 46290 | C | 7/1939 |

OTHER PUBLICATIONS

European Patent Office, Extended European Search Report Issued in Application No. 13853805.3, dated Nov. 8, 2016, Germany, 10 pages.
Australian Patent Office, Office Action Issued in Australian Patent Application No. 2013342120, dated Nov. 18, 2016, 4 pages.
European Patent Office, Extended European Search Report Issued in Application No. 17000089.7, dated Sep. 8, 2017, Germany, 9 pages.

* cited by examiner

FOOTWEAR ARTICLE HAVING CORD STRUCTURE

CROSS REFERENCE TO RELATED APPLICATION

This application is a divisional of U.S. Non-Provisional patent application Ser. No. 14/076,007, filed Nov. 8, 2013, and entitled "FOOTWEAR ARTICLE HAVING CORD STRUCTURE." U.S. Non-Provisional patent application Ser. No. 14/076,007 claims priority to U.S. Provisional Patent Application No. 61/724,797, filed Nov. 9, 2012, and entitled "FOOTWEAR ARTICLE HAVING CORD STRUCTURE." The entire contents of each of the above-identified applications are hereby incorporated herein by reference for all purposes.

BACKGROUND/SUMMARY

Footwear construction typically relies on the manipulation of flat materials into three-dimension shapes in order to form a footwear article. Cloth, leather, or other materials may be cut and sewn or otherwise attached and wrapped around a foot form to create a desired shape for the article, such as a footwear upper.

The Inventors have recognized several drawbacks with this traditional approach. For example, the material used to construct the upper may have only limited degrees of freedom in terms of flexibility, thereby limiting the ways in which the upper conforms to a wearer's foot and reducing comfort. As a result, even after the footwear is worn for a considerable amount of time, it may still not fully conform to the actual contours of the wearer's foot.

To at least partially address the above issues, the inventors herein have taken alternative approaches to footwear construction. In one approach, at least a portion of the upper is formed via a plurality of intertwined cords. For example, the upper may be formed from more than one uninterrupted cords engaging with itself and/or one or more additional cords at a plurality of intertwined, yet at least partially slipping, locations. Due to the slippable intertwined connections between cord sections, the overall shape or contour of the upper portion can change, while at the same time remain flexible. In this way, the upper portion can conform to a wearer's foot with ease, while remaining highly flexible and still providing support.

In another example, a footwear article may include a looped upper with fibers or cords formed into a structure. In one example, the cords in the upper may be in slippable engagement with respect to one another and may be engaged at interfaces with a sole. The cords in the upper may also be interlocked with one another. The slippable engagement may be formed at cord interfaces, the interfaces positioned along a loop line traversing across lateral and medial sides of the upper, and further across a forefoot and/or toe region. The looped upper may be formed in various grid-like patterns. The fiber or cord may comprise grasses, flaxes, and other fibrous plant material. Further, it may comprise artificial polyamides such as nylon, although organic polyamides may also be used. Still further the cord may comprise a polymeric material.

By providing a looped upper with cords slippable relative to one another in the upper, yet having reduced slip at a sole, it is possible to retain a functional footwear article that retained to the wearer's foot, while enabling the upper to form fit to the wearer's foot. For example, the slip between the various cord interfaces enables each cord section between an interface to have a variable length so that the overall upper conforms to the actual shape of the wearer's foot.

It should be appreciated that although described in regards to slippable interfaces, there may be some embodiments and/or portions of the upper where slippage is limited (controlled) and/or prevented as it may not, in some embodiments, be needed or necessary. For example, and not as a limitation, controlled slippage may be provided corresponding to a desired limitation on motion. For example, controlled slippage may be provided to address quick lateral movement where some slippage is provided but limited in distance and/or time. Further, in other embodiments, one or more regions of the upper may be configured for non-slippage, creating a more rigid, non-slip or limited slip interface. As an example, the range of slippage may be controlled by one or more of the slippable interfaces, the length of the cord sections, etc. Further, the type and position of the cord sections and interfaces may further be used to provide controlled slippage.

In another example, a footwear article may comprise a sole coupled to a cord structure. The cord structure may include interconnected bights in a vamp cord and a rand cord forming a loop line extending along at least a portion of the footwear article. The vamp cord and rand cord may each be formed via one or more uninterrupted cords.

Interconnecting bights in the cord structure enables a 3-dimensional form fitting structure to be provided in the footwear article. The connection between the bights can increase the range of motion and freedom of movement of the cord structure when compared to other footwear articles using sewn material which are wrapped around a foot form. As a result, the shape of the cord structure may adjust and conform to a foot with minimal wearing. Consequently, the footwear article's comfort is increased.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE FIGURES

FIGS. 1-21 are shown to scale. However, other relative dimensions may be used if desired.

DETAILED DESCRIPTION

A footwear article constructed of cords is described herein. The footwear article may include interconnected bights in a cord structure providing a 3-dimensional form fitting construction. The cord structure increases the range of motion of an upper part of the footwear article while retaining flexibility and comfort. The cord structure may conform highly to the shape of a foot during use due to the relative movement provided by the bights. For example, by providing an array of bight interconnections across the upper from a lateral to medial side, and across a forefoot region, hundreds of adjustments, for example, can be automatically made by the cord structure so that the appropriate lengths of each cord section between the bights are achieved. As a result, the footwear's comfort is increased.

The example cord structures described herein also enable the manufacturing process of the footwear article to be simplified when compared to other types of shoe construction which use a foot form.

Figure 1:
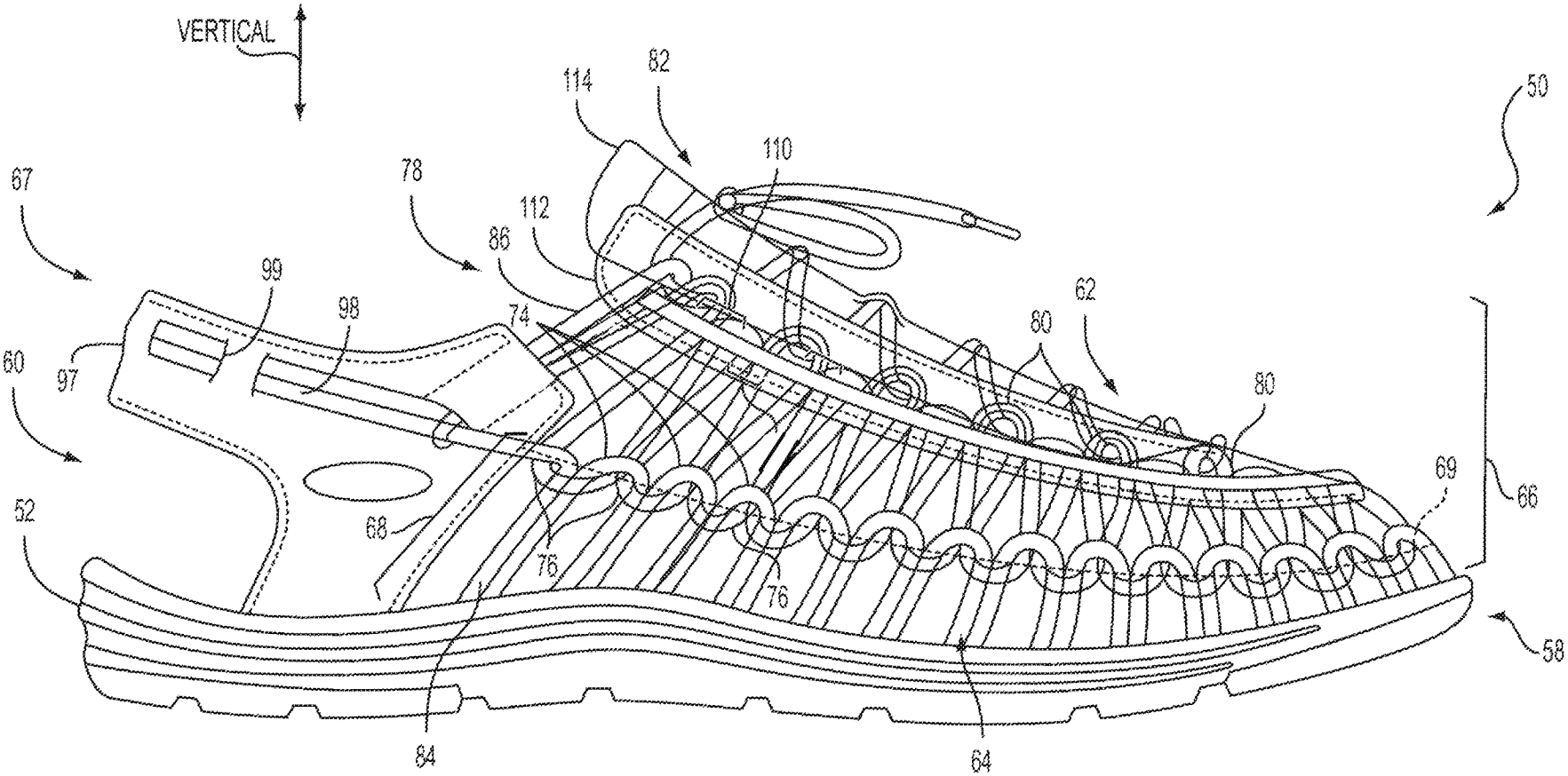
FIG. 1 shows a first example of a footwear article.
Figure 2:
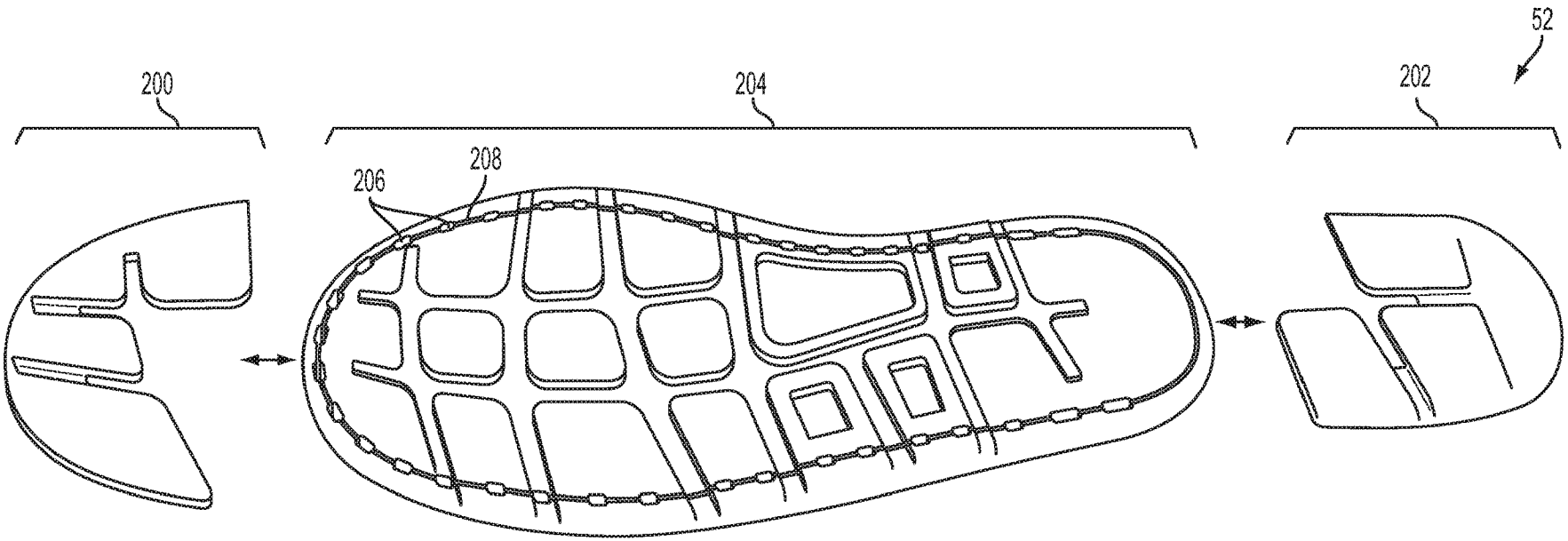
FIG. 2 shows an exploded view of a sole in the footwear article shown in FIG. 1.
Figure 3:
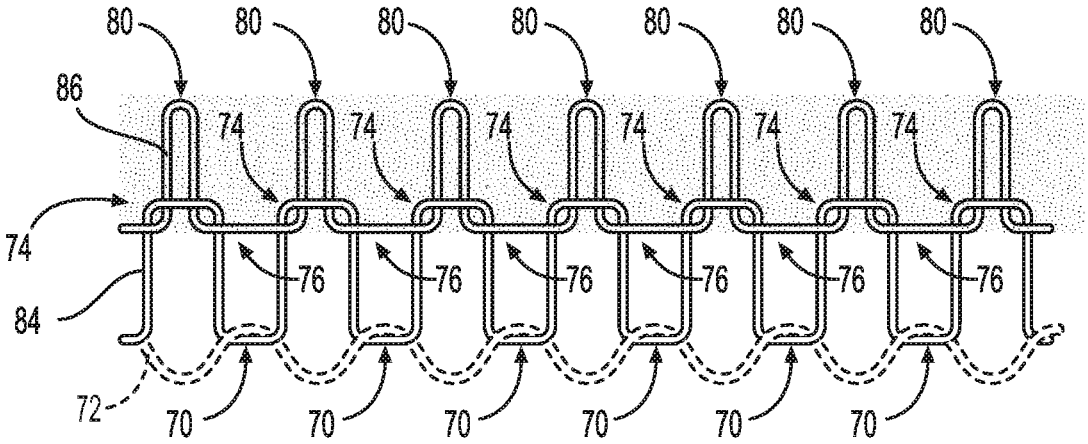
FIG. 3 shows an example intertwined pattern of cords in the footwear article shown in FIGS. 1 and 2.

FIG. 1 shows first example footwear article. FIG. 2 shows an exploded view of a sole included in the footwear article shown in FIG. 1. FIG. 3 shows an example intertwined pattern of cords in the footwear article shown in FIGS. 1 and 2.

Figure 22:
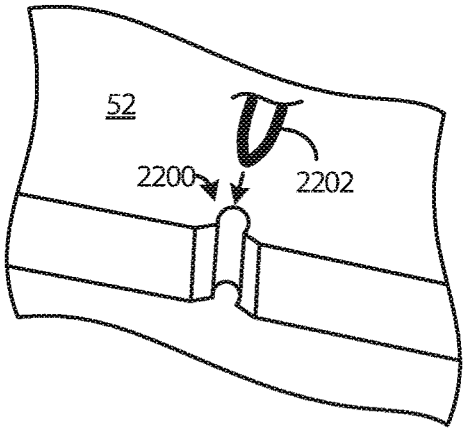
FIGS. 22-24 show sections of different example soles.
Figure 23:
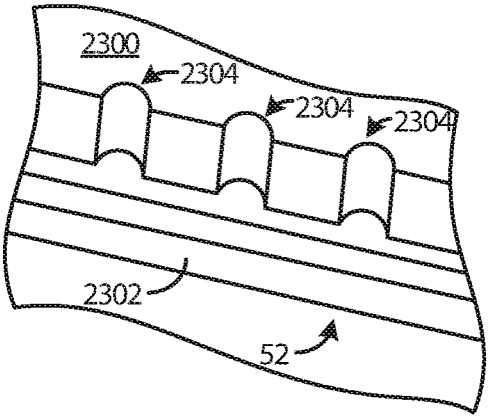
Figure 24:
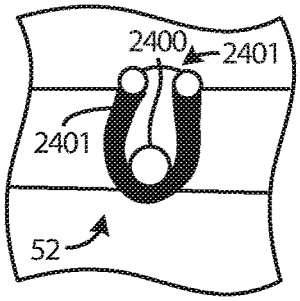

FIGS. 4-9 show different views of a second example footwear article. FIGS. 10-15 show different views of a third example footwear article. FIGS. 16-21 show additional example footwear articles and FIGS. 22-24 shows sections of different example soles.

FIG. 1 shows an example footwear article 50. The footwear article 50 includes a sole 52. The sole 52 may be an insole/midsole, in one example. Thus, the insole and midsole may be single component in the footwear article. However, in other examples, the insole and midsole may be separate components in the footwear article. Further in one example, the footwear article 50 may also include an outsole. However, in other examples the footwear article 50 may not include an outsole or the outsole may be integrated into the sole 52.

The sole 52 is attached to a cord structure 66. The cord structure 66 is included in an upper 67. The cord structure may be formed from numerous cord sections interlocking with one another. The cord may include string, twine, yarn, rope, cable, strands of braided or twisted materials, and/or other cord-like structures including combinations of the previously listed examples twisted together or otherwise combined. In one example, the cord includes nylon cord of approximately a ⅛" diameter, with an outer sheath and inner twine. Of course, other sizing may also be used. In another example, the cord may be double braided nylon, with an inner braid filling a central void and an outer braid that may be of the same or different material. The cord may be flexible yet retain some of its shape in a free state. Further, the cord may have some elastomeric components. Further, different cord sections (e.g., the vamp as compared to the rand) may have different degrees of flexibility, elasticity, etc. In one example, different materials may be used in different sections of the cord structure 66. For instance, a more flexible type of cord may be used in an upper portion of the cord structure 66 and a less flexible type of cord may be used in a lower portion of the cord structure. Additionally, the portions of the cord structure coupled to the sole may be totally covered via the sole, in one example. In another example, the portions of the cord structure coupled to sole the may only be partially covered. For instance, portions of the cord structure proximate to the toes may be covered while portions of the cord structure, proximate to a heel, may be uncovered or vice-versa. Covering portions of the cord structure reduces the likelihood of premature wear of the cord caused by abrasions from rocks, dirt, and/or other particulates from the external environment. As a result, the footwear article's longevity is increased.

In one example, one or more cords in the cord structure 66 may extend through openings in the sole 52 to facilitate coupling of the sole to the cord structure. Additionally alternatively, a portion of the cord structure may be stitched, adhesively bonded (e.g., glued), and/or snapped into the sole to enable the coupling of the sole and the cord structure. In another example, a plurality of anchor points attached to the cord structure may be fixedly attached (e.g., injection molded into) to the sole. The anchor points may be individual cord loops.

In one example, the cord structure 66 may be a looped upper. In such an example, the looped upper may be formed in a grid-like pattern, but substantially free of knots at a plurality of the slippable interfaces positioned away from the sole 52.

The cord structure 66 may be an upper of the footwear article 50. The cord structure 66 may at least partially enclose a foot. The cord structure 66 includes a rand substructure 68. The rand substructure is coupled to the sole 52. Specifically in one example, sole attachment bights in the rand substructure 68 may be coupled to and/or extend through attachment openings in the sole. In one example, the attachment bights may be formed via a single cord in the rand substructure 68. Thus, a single cord may have multiple bights. A bight is a curved portion or section of a greater cord in the cord structure 66. Thus, a bight may be a portion of a loop in a cord.

The rand substructure 68 further includes vamp attachment bights 74. The vamp attachment bights 74 are coupled (e.g., interconnected, interlocked, stitched, intertwined, and/or slidingly engaged) to rand attachment bights 76 included in a vamp substructure 78 in the cord structure 66. The interconnection between the vamp attachment bights 74 and the rand attachment bights forms a loop line 69. The loop line 69 may be an interface between the rand substructure 68 and the vamp substructure 78. The loop line 69 extends in a direction from a heel side 60 of the footwear article 60 to a toe side 58 of the footwear article. The loop line 69 also extends from a tibular side 62 of the footwear article 50 to a fibular side 64 of the footwear article. The loop line 69 may peripherally extend around the footwear article, and in one example may traverse around the entire upper. Further it will be appreciated that the loop line 69 may extend in an arc around at least a portion of the footwear article 50. Other loop line configurations have been contemplated. For instance, the loop line may extend across the footwear article from a first later side to a second lateral side. Further in another example, the loop line may extend around the footwear article in an arc, from a first side of a heel counter to a second side of a heel counter. Still further in another example, the loop line may laterally extend across the footwear article as well as extend in an arc around a front of the footwear article (e.g., toe side). Even further in another example, the loop line may only extend around a portion of the footwear article, such as a portion adjacent to a toe side or a heel side of the footwear article. Further still in one example, the footwear article may include a plurality of loop lines.

The vamp substructure 78 is spaced away (e.g., vertically spaced away) from the sole 52, in the depicted example. Additionally, the rand substructure 68 may be positioned vertically above the sole 52 and the vamp substructure 78 may be positioned vertically above the rand substructure. A vertical axis is provided for reference. However, it will be appreciated that other footwear article orientations may be used if desired. It will be appreciated that the vamp substructure 78 may be spaced away from the sole 52 when the footwear article is not being worn. The cord structure 66 may retain it shape due to the interconnection between the vamp substructure 78 and the rand substructure 68, along with the internal structure of the cord. Example interconnections are discussed in further detail herein.

FIG. 3 shows a more detailed view of the at least partially sliding interconnection between the vamp attachment bights 74 and the rand attachment bights 76. It will be appreciated that the vamp attachment bights 74 are shown interlocked with rand attachment bights, as depicted in FIG. 3. In this way, the vamp substructure may be coupled to the rand substructure without the use of adhesive, if desired. However, it will be appreciated that in some examples adhesives may be used to couple certain elements in the footwear article. In one example, the sliding connection between the bights may be free of knots. However in another example, at least a portion of the vamp attachment bights 74 may be fixedly coupled to at least a portion of the rand attachment bights 76. In another example, stitched locks may be used to provide the partially sliding interconnection. For instance, loose or tight stitched interfaces may be provided at the junctions of the cords in the upper. By controlling the amount of slippable engagement in various sections of the footwear article desired fitting characteristics may be achieved to increase the wearer's comfort.

Returning to FIG. 1, the vamp substructure 78 further includes lace attachment bights 80. The lace attachment bights 80 are shown coupled to a lace cord 82 in FIG. 1. Specifically, the lace cord 82 extends through the lace attachment bights 80. The length of the lace cord 82 may be adjusted by the wearer. However, alternate lace cord configurations have been considered. For instance, the footwear article may be constructed without a lace cord. In this way, a wearer can quickly and easily slip on and off the footwear article without the need to tie a lace cord. In such an example, elastic material may be provided in the footwear article to enable controlled expansion and contraction of portions of the cord structure. Additionally, different lacing patterns have been considered. For instance, the cord structure may include eyestays. Cords in the cord structure may extend through the eyestays. Additionally, the eyestays may include eyelets and/or loops and are described in greater detail herein with regard to FIG. 16.

The lace cord 82 may be included in the cord structure 66, in some examples. However, in other examples the lace cord 82 may not be included in the cord structure 66. In such an example, elastic or other suitable material may be used to provide the footwear article with a slip-on capability.

Numerous relative vamp cord, rand cord, and/or lace cord lengths have been contemplated. Portions of the rand cord 84 and the vamp cord 86 are also shown in FIG. 3. The sole attachment bights 70 are also shown in FIG. 3. A sole cord 72 is also shown in FIG. 3, the sole cord may be included in the cord structure 66 shown in FIG. 1. As illustrated, the sole cord 72 is intertwined with the sole attachment bights 70.

It should be appreciated, that the construction method described herein enables, in some embodiments, options for customizing sizing and for adjusting sizing with minimal tooling expenditures. For example, the construction of the upper based on a cord length enables variation in size without changing the upper pattern or obtaining different size cutting dies. As such, in some embodiments, the size of the upper can be altered by varying the cord length. The loops may remain in their relative position for each size. Such construction reduces costs by utilizing same size tooling.

Likewise, customization of the footwear may be applied to improve fit for a specific user. With generation of an electronic scan of a foot, a customized and personalized cord may be used to generate customized footwear based on the foot scan. For example, the lengthening (or shortening) of the loops, the positioning and sizing of the loop line, and the adjustment of cord size may be adjusted alone or in combination to tailor the upper to the specific dimensions of the scanned foot to provide a customized fit.

Turning back to FIG. 1, the rand cord 84 and the vamp cord 86 are depicted as being round cords in FIG. 1. However, other shapes have been contemplated. For instance, one or more of the cords may be flat cords or one or more of the cords may have flat ends and round midsections. In another example, one or more of the cords may have one or more flat sections and one or more round sections. For instance, a cord may include a round section followed by a flat section and so on and so forth. Additionally, the sole cord 72 shown in FIG. 3 may be flat, round, or have different sections with varying geometries. Additionally, the rand cord 84, the vamp cord 86, and the lace cord 82 are all depicted as having a similar cross-sectional area (e.g., diameter) and/or geometry. In one example, the diameter of one or more of the cords may be between $1/8^{th}$ of an inch and $1/16^{th}$ of an inch. However, in other examples the cords may have varying widths. It will be appreciated that the sole cord 72 shown in FIG. 3 may have a similar geometry to the rand cord, vamp cord, and/or lace cord, in one example. However, in other examples, the cross-sectional area and/or geometry of the rand cord 84, the vamp cord 86, sole cords 72, and/or lace cord 82 may vary. For example, the cross-sectional area of the rand cord may be larger than the vamp cord. In another example, the rand cord may be circular and the vamp cord may be flat.

Further in some examples, the rand cord 84, vamp cord 86, and/or lace cord 82 may comprise similar material(s). However, in other examples the aforementioned cords may comprise different materials. One or more of the cords may comprise synthetic fibers such as Polypropylene, Nylon, Polyester, Polyethylene, Aramid, and/or Acrylate polymer. Additionally, one or more of the cords may comprise natural fibers such as cotton, linen, coir, etc. Further in one example, one or more of the cords may comprise a polymeric material.

Additionally, the rand cord 84, vamp cord 86, and/or lace cord 82 may be designed with different material properties to enable the footwear article have desired structural characteristics. For example, the lace cord 82 may have a greater elasticity than the rand cord 84 and/or the vamp cord 86.

As shown in FIG. 1, the vertical height of the vamp attachment bights increases in a reward direction extending toward the heel side 60 of the footwear article 50. The width of the interlocked vamp cord sections extending from the lace cord to the rand cord may also increase in the reward direction extending toward the heel side 60 of the footwear article 50.

The footwear article 50 also includes a heel counter 97. The heel counter or other support structures in the footwear article may be included in the upper discussed above. It will be appreciated that the rigidity/flexibility of the heel counter 97 may be selected to provide a desired amount of support to the cord structure 66. Specifically, the heel counter 97 may prevent the cord structure from flexing outward and/or downward in a direction toward the sole by an undesirable amount. In this way, the cord structure may maintain a desired shape. As a result, a wearer of the footwear article may quickly and comfortably put on and take off the footwear article. The heel counter 97 may comprise a different material than the cord structure 66, such as leather, synthetic leather, fabric, etc. However, in some examples the heat support structure may also comprise cord. The loop line 69 may extend through the heel counter 97 in some examples. Additionally, the heel counter 97 may be coupled to the sole 52. Specifically, in some examples the heel counter structure may extend (e.g., vertically or angularly) from the sole 52. The heel counter 97 is coupled to the rand substructure 68, in the depicted example. A connection cord 98 is shown extending through bights in the rand substructure 68 and through an opening 99 in the heel counter 97. In this way, the heel counter 97 provides support to the cord structure as well as shields a portion of the cord structure from the external environment. Additionally or alternatively, the heel counter 97 may be coupled to the vamp substructure 78, thereby providing support to the substructure. The heel counter may have a greater rigidity than the cord structure 66. In one example, the connection cord 98 may be a portion of the vamp cord 86 or the rand cord 84. Additionally, a portion of the cord structure extends around the width of the heel counter 97. However, other heel counter configurations have been contemplated. In one example, ends of cords in the cord structure may be coupled to the heel counter and/or coupled to one another within the heel counter. In one example, the heel counter 97 may have greater stiffness in a longitudinal direction than a lateral direction. The vertical stiffening of the support may provide a desired amount of support to the cord structure. However, other heel counter 97 material characteristics have been contemplated.

The footwear article 50 shown in FIG. 1 further includes an eyestay 110. Cords in the cord structure 66 may extend through the eyestay 110. It will be appreciated that more than one cord section extends though the eyestay 110, in the depicted example. However in other examples, alternate eyestay designs have been contemplated. The eyestay 110 may provide desired cord spacing and cord support to the cord structure. In this way, the eyestay 110 may limit the free movement of the cords extending therethrough. The eyestay 110 may be included in an upper structure 112. In one example, the upper structure 112 may be adjacent to a tongue 114 of the footwear article. The upper structure may comprise a different material than the cord structure, in one example. Example eyestay materials include cloth, leather, synthetic leather, fabric, polymeric material, etc. In other examples, the footwear article may include a plurality of eyestays.

Figure 20:
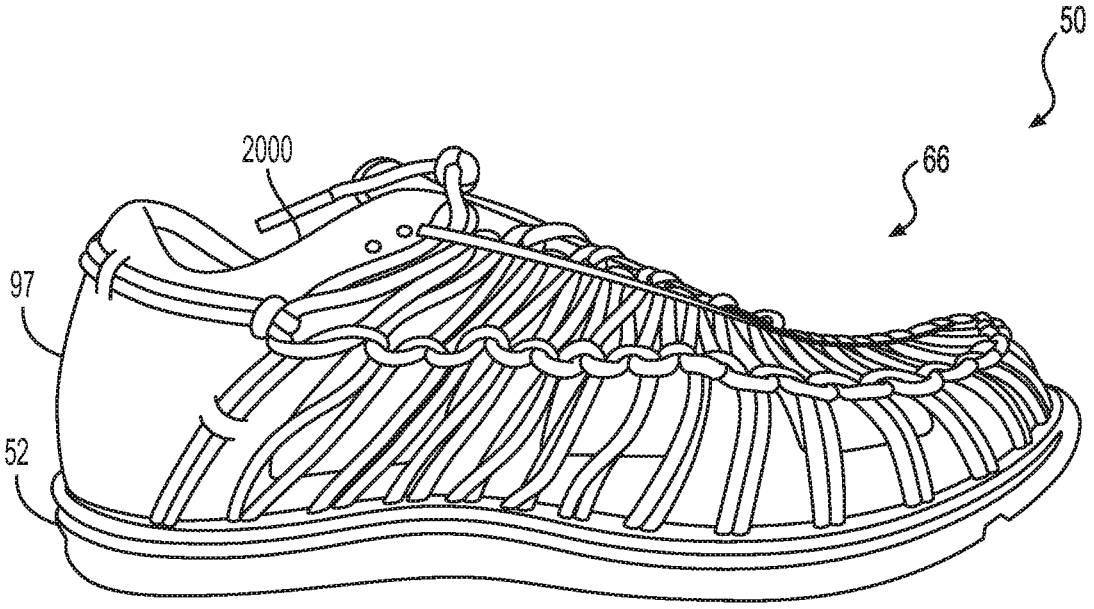

Additionally in the example shown in FIG. 20, the footwear article 50 may include a bootie 2000 at least partially enclosed by the cord structure 66. The bootie 2000 may be coupled to the cord structure 66, in some examples. However, in other examples the bootie 2000 may not be coupled to the cord structure 66. The bootie 2000 may be in the shape of a sock, in one example. Additionally, the bootie may comprise a material such as neoprene, in one example. The bootie provides increased insulation to the wearers foots and provides additional protection from the external environment.

Additionally, one or more sheaths may enclose (e.g., circumferentially enclose) a portion of at least one of the rand cord 84 and vamp cord 86, in some examples. Therefore, the sheaths may surround various sections of the cords in the cord structure. For instance, a plurality of sheaths may surround a portion of the rand cord 84 from vamp attachment bights 74 to the rand attachment bights 76. Thus, the sheaths may act as protective covers for the cords. In some examples, the sheath may be in face sharing contact with an outer surface of the cord. However, in other examples, the sheath may be spaced away from an outer surface of the cord. The sheaths may be cylindrical, in one example. However, other sheath geometries have been contemplated. Additionally, a plurality of sheaths may be used to form a toe cap around the toe side of the footwear article. The sheaths may provide increased structural integrity to desired areas of the cord structure 66, to enable the cord structure 66 to retain a desired shape. The sheaths may comprise a different material than the vamp cord and/or the rand cord. In one example, the sheaths may comprise a polymeric material. The sheaths may also protect the cords from damage.

FIG. 2 shows an exploded view of an example sole 52. As previously discussed the sole 52 is included in the footwear article 50 shown in FIG. 1. The sole 52 includes a first portion 200, a second portion 202, and a third portion 204. In an assembled configuration the first and second portions (200 and 202) may be coupled (e.g., stitched, adhesively bonded, snapped, etc.) to the third portion 204. Additionally, in the assembled configuration surfaces in the first and second portions (200 and 202) may conform to contours (e.g., mate) with surfaces in the third portion 204. Thus, surfaces in the second and third portions may be in face sharing contact with surfaces in the first portion.

Additionally, the third section 204 includes a plurality of openings 206. In one example, there may be 17 opening on each lateral side of the sole. In another example, there may be less than 26 openings on each lateral side of the sole. Still further in another example there may be less than 30 openings on each lateral side of the sole or between 15 and 30 openings on each lateral side of the sole. Sequential openings may spaced away from one another by 4 millimeters (mm) or greater. It will be appreciated that the spacing and the sizing of the openings affect the structural characteristics of the sole. For instance, if the sole contains too many opening the integrity of the sole may be compromised. Therefore, the sole may have a maximum number of openings and/or a maximum opening separation, in one example. The size of the openings may be determined based on the size of the cords, the type of tooling machines used in manufacturing, etc. In one example, the size of the cord (e.g., cord diameter or thickness) may directly correlate to the size of the holes. In the depicted example, a portion of the openings have a similar geometry and size. However, other opening geometries and sizing have been contemplated. One or more cords in the cord structure may extend through the openings, as previously discussed.

Additionally, the number of eyestays in the cord structure, discussed in greater detail herein, may correlate (e.g., directly correlate) to the number of openings in the sole. Specifically in one example, the number of eyestays may be equivalent to the number of openings in the sole. Further in one example, a single cord may extend from the eyestays to the openings in the sole. For instance, the cord may extend through an eyestay and then an opening in the sole and so on and so forth. However, other cord configurations have been contemplated. For instance, different cords may extend through the eyestays and the attachment openings in the sole. Further in another example, one cord may extend through a portion of the eyestays and the openings and a second cord may extend through the remaining eyestays and a third cord may extend through the remaining openings.

Continuing with FIG. 2, a sole cord and/or other cord included in the cord structure of the footwear article may be positioned between the first portion 200 and the third portion 204 and/or the second portion 202 and the third portion 204. In this way, the cord is protected from the external environment which may transfer dirt, rocks, and/or other particulates to the cords. Consequently, wear to the cord structure is reduced, thereby increasing the footwear article's longevity. However, in other examples at least a portion of the cord structure may be exposed to the external environment. Constructing the sole in multiple pieces may also simplify footwear article assembly, thereby reducing manufacturing costs. Additionally, the sole cord 72, shown in FIG. 3, may be positioned in a recess 208 extending around a periphery of the sole. However, other sole cord positions have been contemplated. For instance, the sole cord may extend across the sole from a first lateral side to a second lateral side one or more times. Furthermore, the unassembled sole cord may include a first end and a second end. It will be appreciated that the ends of the sole cord may be attached to one another or other components in the footwear article, when assembled. Additionally, the sole cord may comprise a polymeric material.

Sole attachment bights included in the cord structure 66 shown in FIG. 1 may attach to the sole cord positioned in the recess 208 shown in FIG. 2. The sole attachment bights may be positioned in each of the openings 206. The rand attachment bights shown in FIG. 1 may be coupled (e.g., interconnected, interlocked, etc.) with the sole attachment bights. In this way, the sole cord may be coupled to the rand cord without the use of adhesives, if desired.

Figure 4:
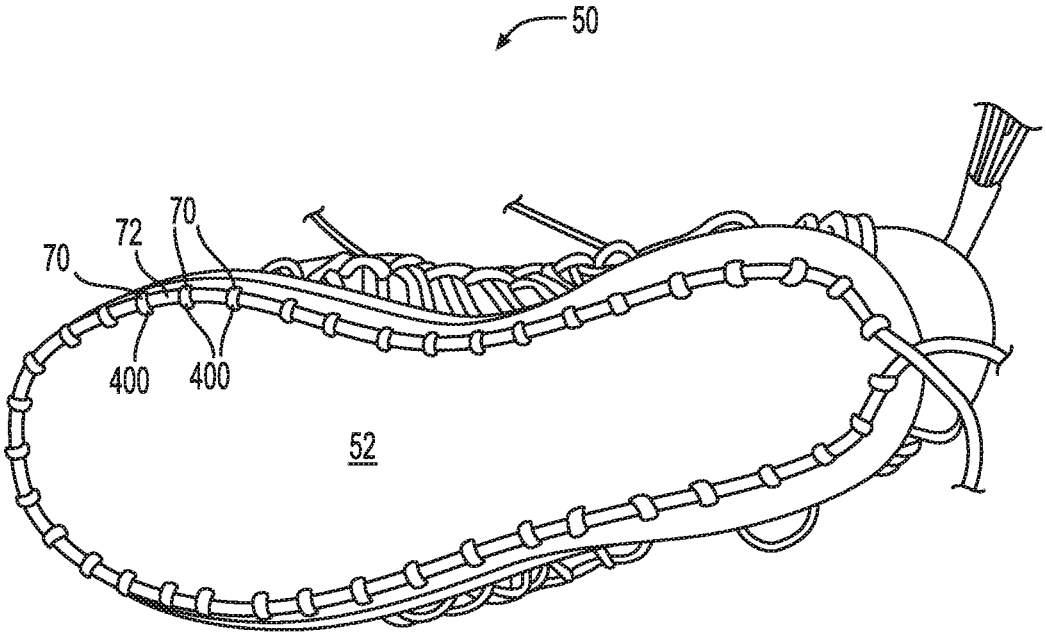
FIGS. 4-9 show different views of a second example footwear article.

FIGS. 4-9 show various views of a second example footwear article 50. Specifically FIG. 4 shows a bottom view of the second example footwear article 50. As illustrated, the sole cord 72 traverses a bottom surface of the sole 52. Specifically, the sole cord 72 follows a peripheral path around the sole 52. Thus, the sole cord 72 shown in FIG. 4 does not laterally traverse the sole a plurality of times, as shown in FIG. 2. However, other sole cord positions have been contemplated. For instance, the sole cord may extend around a periphery of the sole in a first section and traverse the sole in a second section. Further in the depicted example, each of the sole attachment bights 70 extends through a single opening 400 in the sole. However, other sole attachment bight configurations have been contemplated. The opening may be included in the plurality of attachment openings 54, discussed above with regard to FIG. 1.

Figure 5:
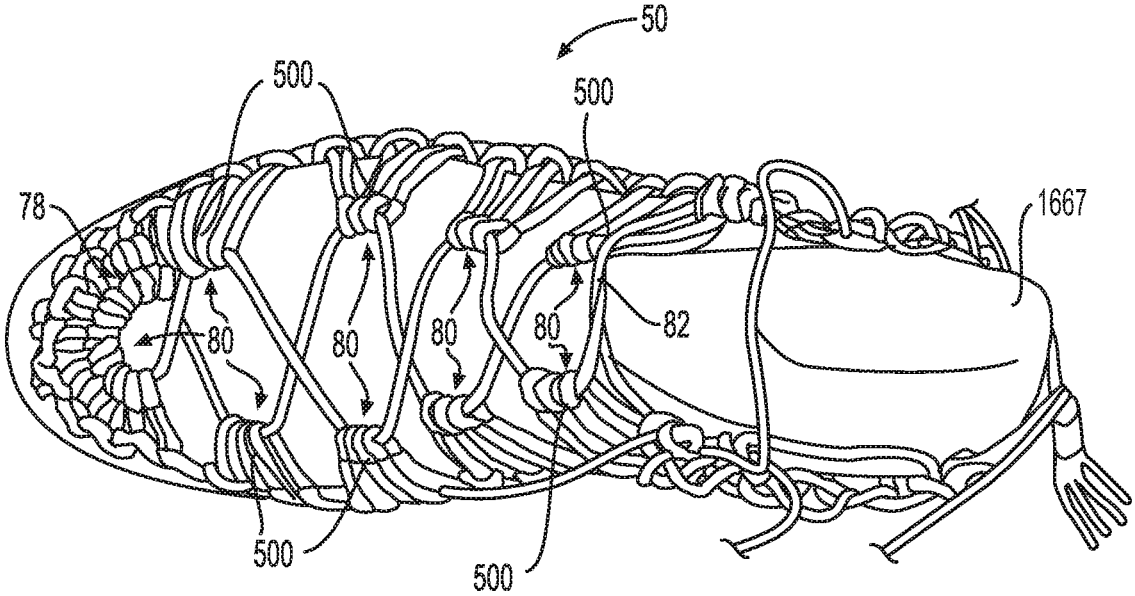

FIG. 5 shows a top view of the second example footwear article 50 including the cord structure 66. Portions of the vamp substructure 78, such as the lace attachment bights 80, are grouped together via string 500 and/or other suitable attachment techniques. Grouping lace attachment bights 80 enables a different lacing pattern to be used in the footwear article 50 and the rand substructure 68. The grouped cords may be selectively chosen based on desired end use characteristics. In one example, sections of the cords may be grouped while other sections may be decoupled from one another. It will be appreciated that in FIG. 5 the rand substructure 68 is coupled to the vamp substructure 78 in a similar manner to the coupling technique shown in FIG. 1. A foot mannequin 1667 and lace cord 82 are also shown in FIG. 5. As illustrated, the lace cord 82 extends through the lace attachment bights 80.

Figure 6:
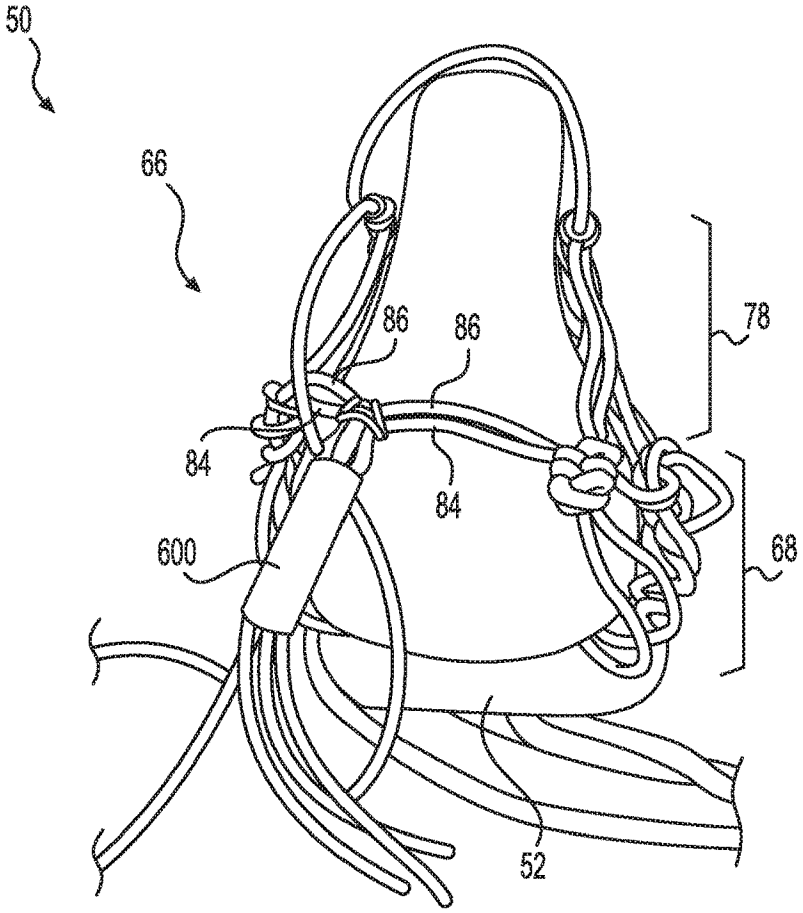

FIG. 6 shows a rear view of the second example footwear article 50. The sole 52, rand substructure 68, and vamp substructure 78 are shown in FIG. 6. The rand cord 84 and the vamp cord 86 are also shown in FIG. 6. The rand cord 84 and the vamp cord 86 are attached via tape 600. However, other suitable coupling techniques have been contemplated. For example, the rand cord 84 and vamp cord 86 may be stitched together, attached via snaps, clips, etc. In some examples, the location of the attachment point between the rand cord 84 and the vamp cord 86 may be adjustable, enabling the footwear article to be customized by the wearer. The ends of the cords in the rand substructure and/or vamp substructure may be attached near the heel side of the footwear article. The ends may be stitched, glued (e.g., cemented), tied, and/or taped together. Additionally or alternatively, a portion of the rand substructure and/or the vamp substructure may be at least partially enclosed via a protective sleeve. In such an example, the ends of the cords in the substructures may be glued, stitched, tied, and/or taped together in the protective sleeve and/or coupled to a portion of the protective sleeve. In this way, the ends of the cords are not in direct contact with a wearer's foot which may improve the footwear's comfort.

Figure 7:
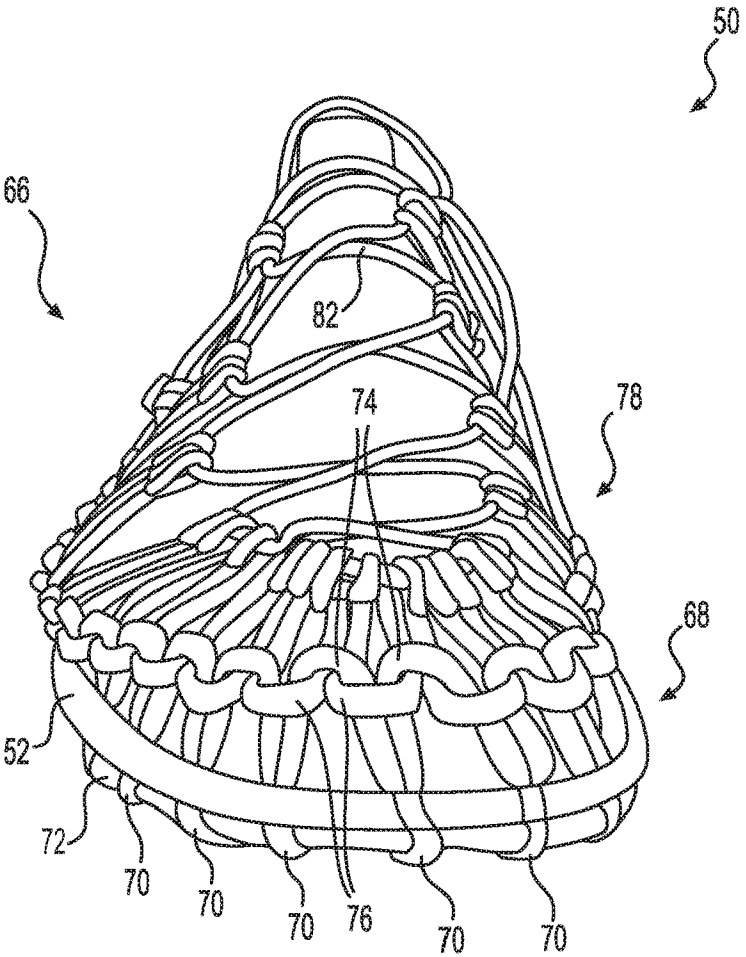

FIG. 7 shows a front view of the second example footwear article 50 including the cord structure 66. The sole 52, sole cord 72, rand substructure 68, vamp substructure 78, and the lace cord 82. It will be appreciated that the rand substructure 68 is coupled to the vamp substructure 78 in a similar manner to the first example footwear article shown in FIG. 1. The rand attachment bights 76 in the vamp substructure are interconnected with the vamp attachment bights 74 in the rand substructure to form an attachment interface in the second example footwear article 50, shown in FIG. 7. The sole attachment bights 70 are again shown extending through the sole 52. However, other sole attachment bight configurations have been contemplated.

Figure 8:
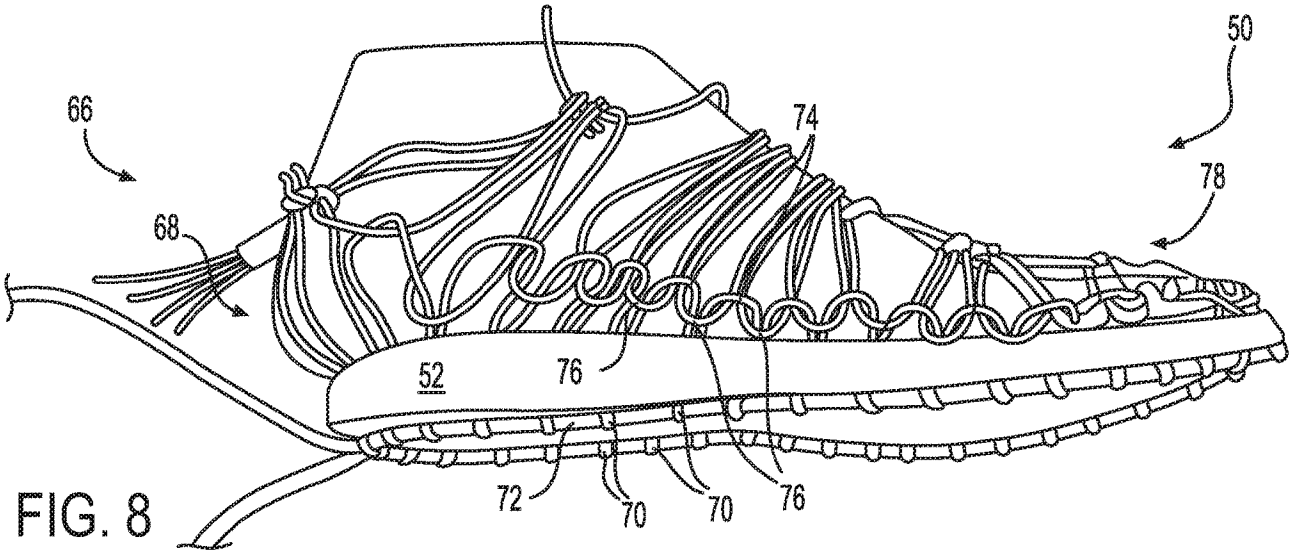

FIG. 8 shows a first side view of the second example footwear article 50 including the cord structure 66. The sole 52, sole cord 72, rand substructure 68, and vamp substructure 78 are also depicted in FIG. 8. The sole cord 72 is shown extending through sole attachment bights 70. As shown, the rand attachment bights 76 in the vamp substructure are interconnected with the vamp attachment bights 74.

Figure 9:
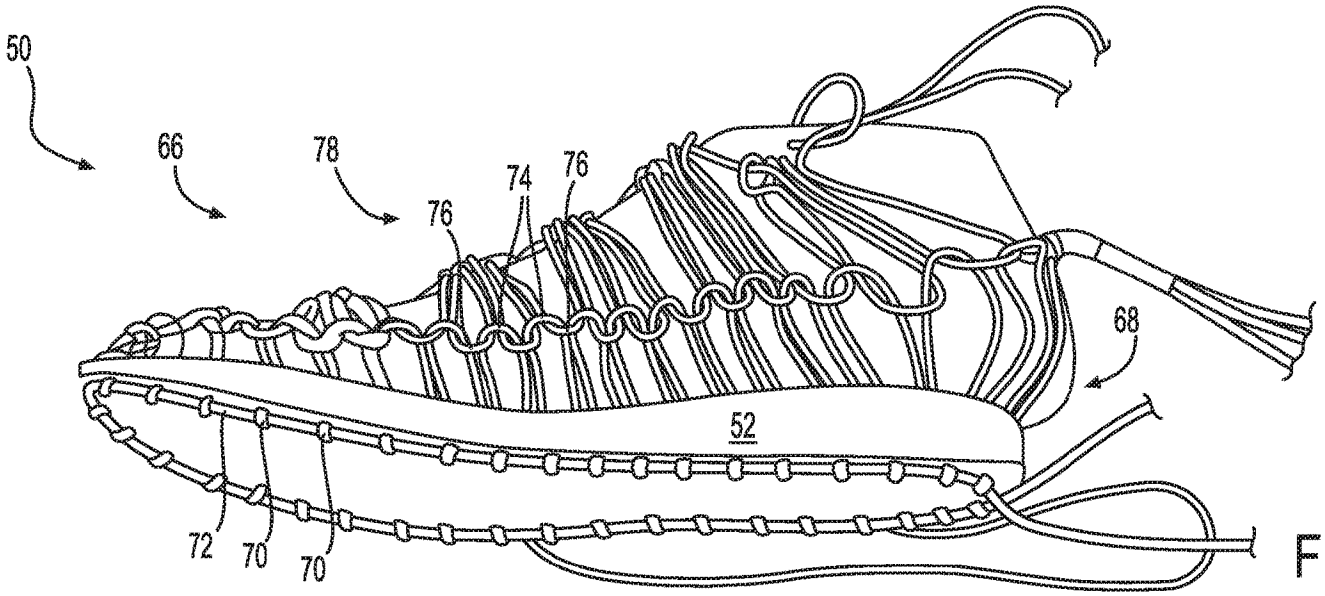

FIG. 9 shows a second side view of the second example footwear article 50 including the cord structure 66. Again, the sole 52, sole cord 72, rand substructure 68, and vamp substructure 78 are also shown. The sole cord 72 is also shown extending through sole attachment bights 70. As illustrated, the rand attachment bights 76 in the vamp substructure are interconnected with the vamp attachment bights 74.

Figure 10:
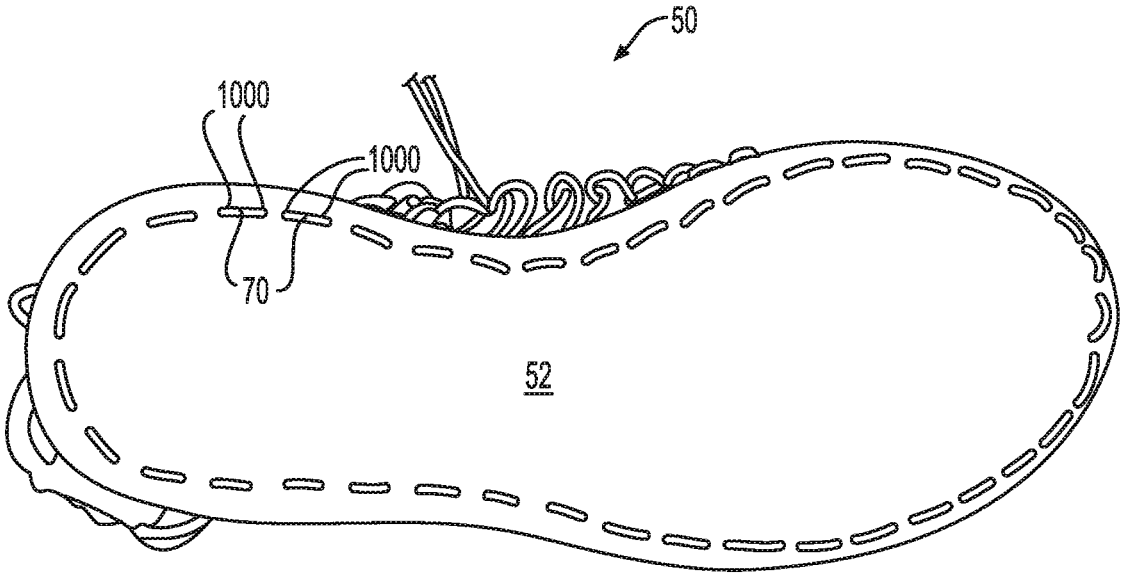
FIGS. 10-15 show different views of a third example footwear article.

FIGS. 10-15 show various views of a third example footwear article 50. Specifically, FIG. 10 shows a bottom view of the third example footwear article 50. The sole 52 and sole attachment bights 70 are shown in FIG. 10. It will be appreciated that the sole cord has been omitted from the example footwear article shown in FIG. 10. Thus, each sole of the sole attachment bights 70 extends through two openings 1000 in the sole 52. In one example, the sole attachment bights 70 may be stitched and/or glued to the sole. In this way, a greater amount of attachment strength may be provided between the attachment bights and the sole, decreasing slippable engagement. In one example, the cord may be engaged with the sole, including locked, partially-locked, slippably engaged, or limited slippably engaged).

Figure 11:
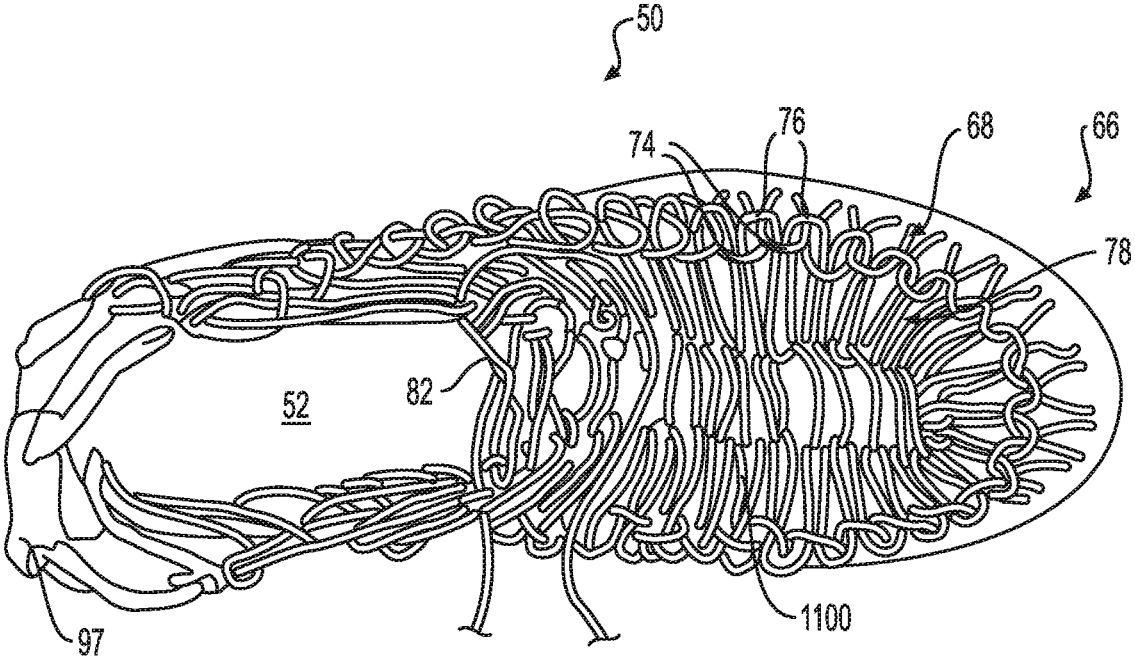

FIG. 11 shows a top view of the third example footwear article 50 including the cord structure 66. The sole 52, rand substructure 68, vamp substructure 78, lace cord 82, and heel counter 97, are shown in FIG. 11. A string 1100 or other suitable cord may be interlaced through the vamp substructure 78 to provide additional support to the structure. As illustrated, the rand attachment bights 76 in the vamp substructure are interconnected with the vamp attachment bights 74. It will be appreciated that in the third example footwear article 50 the rand substructure 68 is coupled to the vamp substructure 78 in a similar manner to the first and second example footwear articles, discussed above. However, other coupling techniques have been contemplated.

Figure 12:
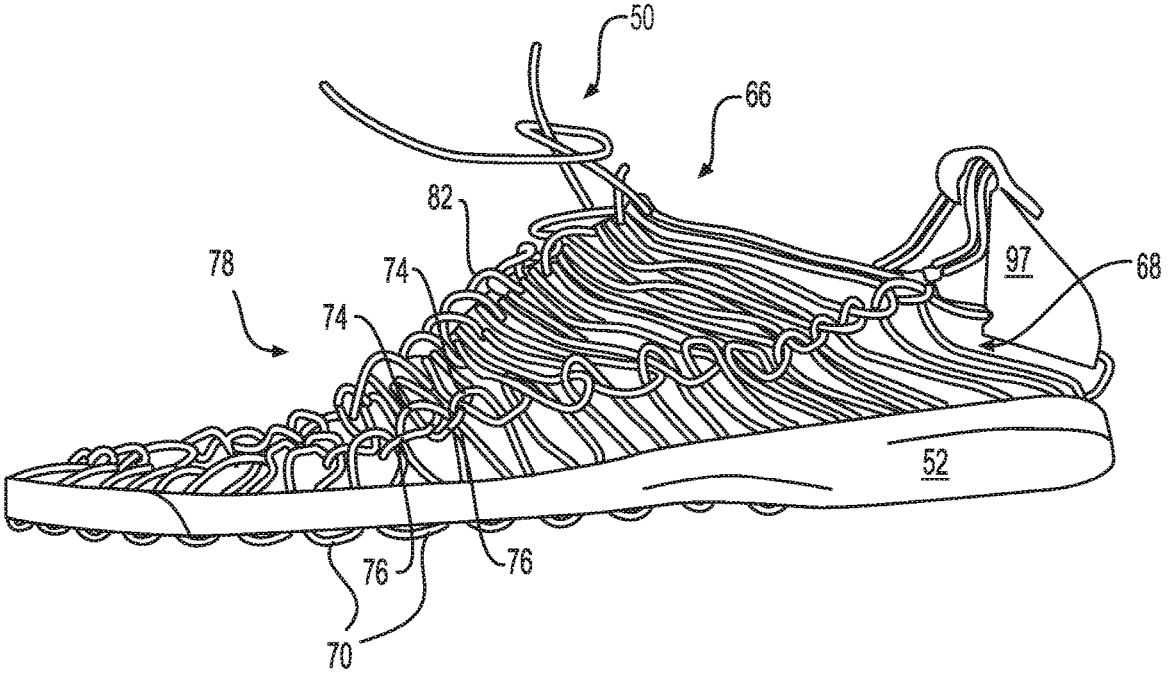
Figure 13:
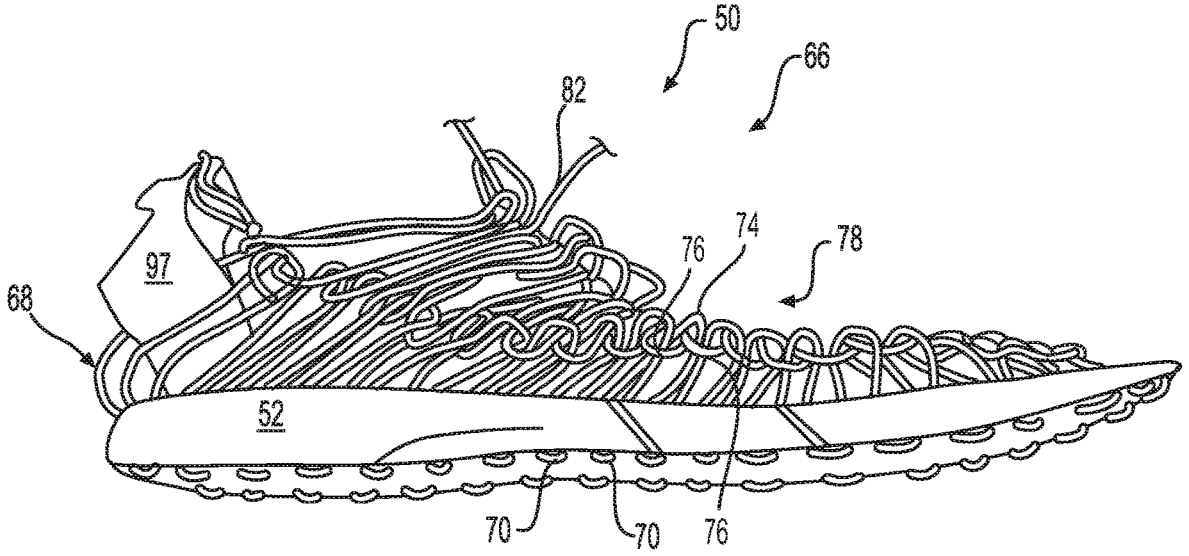

FIGS. 12 and 13 show different side views of the third example footwear article 50 including the cord structure 66. The sole 52, rand substructure 68, vamp substructure 78, heel counter 97, and lace cord 82 are also shown in FIGS. 12 and 13. As illustrated, the rand attachment bights 76 in the vamp substructure are interconnected with the vamp attachment bights 74 and the rand substructure. It will be appreciated that each of the sole attachment bights 70 includes a first portion extending through a first opening in the sole 52 and a second portion extending through a second opening in the sole 52. In this way, the sole cord may be omitted, if desired.

Figure 14:
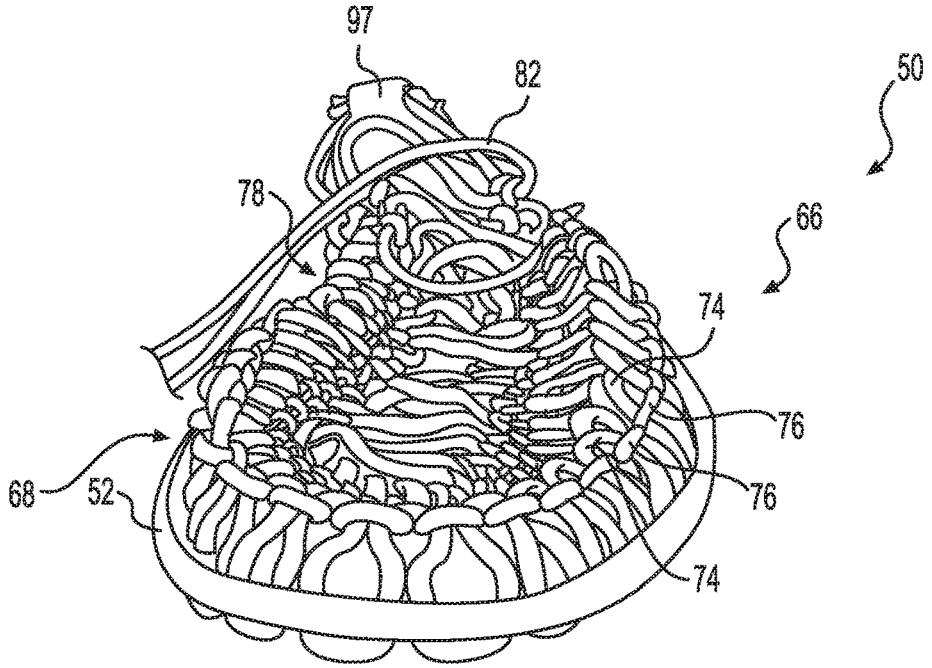

FIG. 14 shows a front view of the third example footwear article 50 including the cord structure 66. The sole 52, rand substructure 68, vamp substructure 78, heel counter 97, and lace cord 82 are also shown in FIG. 14. As illustrated, the rand attachment bights 76 in the vamp substructure are interconnected with the vamp attachment bights 74.

Figure 15:
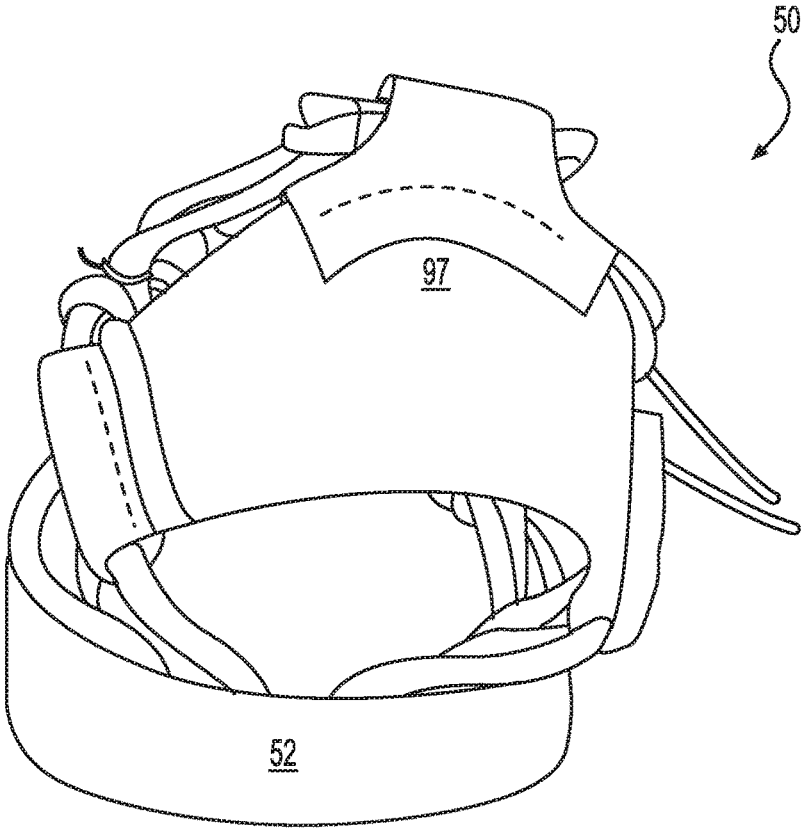

FIG. 15 shows a rear view of the footwear article 50. The heel counter 97 and sole 52 are shown in FIG. 15. The heel counter 97 provides support and retention to a person's heel. In this way, the comfort of the footwear article is increased. Parts of selected cords in the cord structure 66 may extend through the heel counter 97. Additionally or alternatively, the parts of the selected cords may be coupled to the heel counter.

Figure 16:
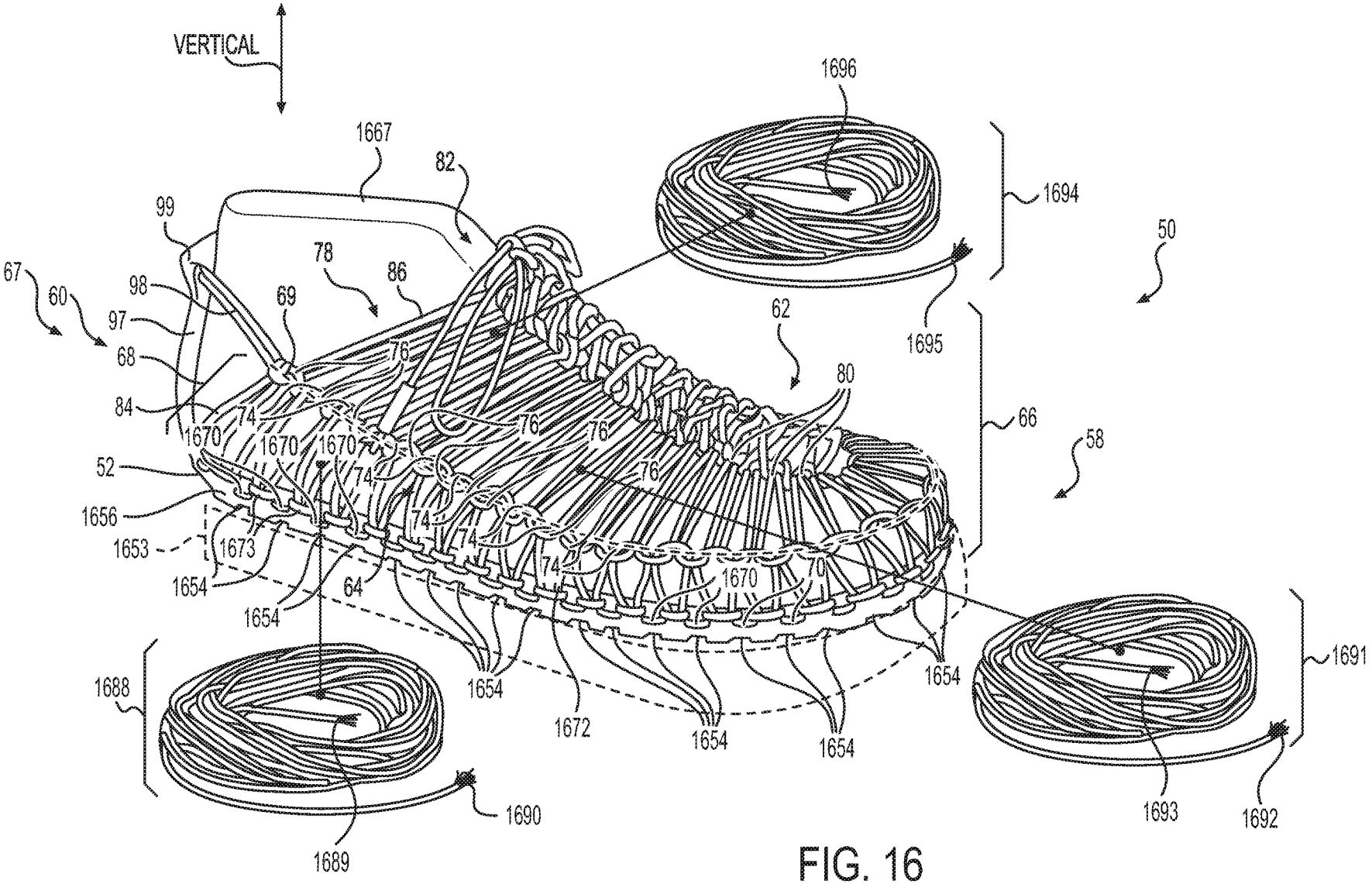
FIG. 16-21 shows different example footwear articles.

FIG. 16 shows another example footwear article 50. The footwear article shown in FIG. 16 includes the cord structure 66 and sole 52. As discussed above the cord structure 66 is included in the upper 67. The cord structure 66 includes the rand substructure 68 and the vamp substructure 78. The vamp substructure 78 includes rand attachment bights 76 and the rand substructure 68 includes vamp attachment bights 74. The loop line 69 is also depicted in FIG. 16. The lace cord 82, rand cord 84, sole cord 72, and vamp cord 86 are also shown in FIG. 16. Additionally, the heel counter 97, connection cord 98, and openings 99 are shown in FIG. 16.

The footwear article 50 may further include an outsole 1653. The outsole 1653 may be coupled to the sole 52. For instance, the outsole 1653 may be stitched or otherwise attached to the insole/midsole 52. However, in other examples the outsole may not be included in the footwear article or the outsole may be integrated into the sole. A foot mannequin 1667 is depicted for reference in FIG. 16.

In the example depicted in FIG. 16 the rand substructure 68 includes only a single rand cord 84, and the vamp substructure 78 includes a single vamp cord 86. However, more than one cord or cord section may be used to form the rand substructure or the vamp substructure, in other examples. A rand cord prior to construction of the cord structure 66 is shown at 1688. The unassembled rand cord includes a first end 1689 and a second end 1690. It will be appreciated that the ends of the rand cord may be attached to one another or other components in the footwear article when assembled. A vamp cord prior to construction of the cord structure is shown at 1691. The unassembled vamp cord includes a first end 1692 and a second end 1693. It will be appreciated that the ends of the vamp cord may be attached to one another or other components in the footwear article when assembled. A lace cord prior to construction of the cord structure 66 is show at 1694. The lace cord includes a first end 1695 and a second end 1696.

The sole 52 includes attachment openings 1654. In the depicted example, the attachment openings 1654 are gaps positioned around a periphery 1656 of the sole 52. However, in other examples, the attachment openings 1654 may be apertures offset or otherwise spaced away from the periphery of the sole 52. The attachment openings 1654 extend from the toe side 58 of the footwear article 50 to the heel side 60 of the footwear article. The attachment openings 54 also extend from the tibular side 62 of the footwear article 50 to the fibular side 64 of the footwear article.

Sole attachment bights 1670 may extend through the attachment openings 1654. Specifically, in one example, the sole attachment bights 1670 may extend from a top side of the sole 52 to a bottom side of the sole. However, other sole attachment bights positions have been contemplated. The bights may be used for attachment and coupling between components in the footwear article 50. The sole cord 72 may extend through the sole attachment bights 1670. Specifically, rand attachment bights 1673 in the sole cord 72 may be coupled (e.g., interconnected, interlocked, intertwined, pulled through, pushed through, or punched through) to the sole attachment bights 1670. Specifically in one example, the sole cord 72 may be fixed on attachment bights 1673. However in another example, the attachment bights 1673 in the sole cord 72 may not be coupled to the sole attachment bights 1670. The sole cord 72 and the attachment between the rand attachment bights 1670 in the sole cord 72 and the sole attachment bights 1670 in the rand cord are discussed in greater detail herein with regard to FIG. 2.

Figure 17:
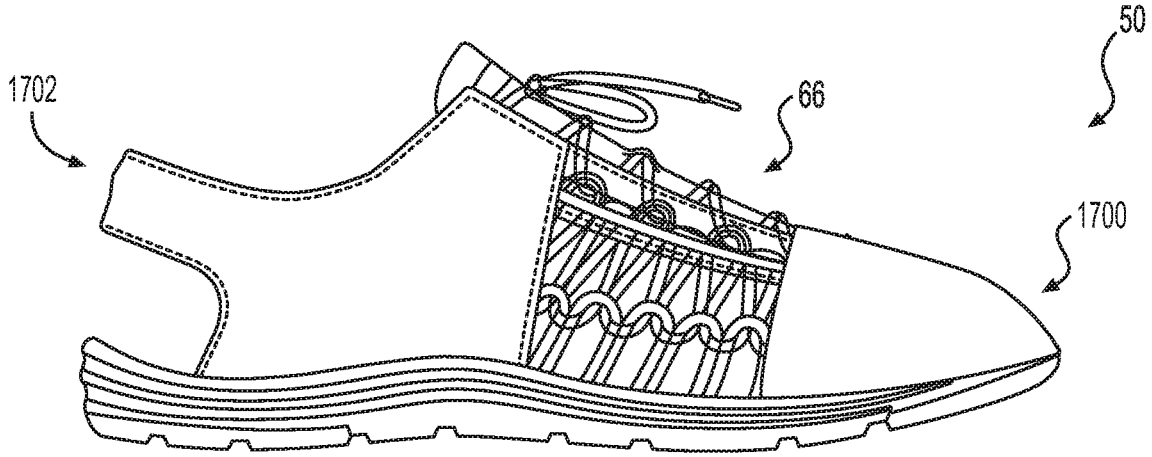

FIG. 17 shows another example footwear article 50. The footwear article 50 shown in FIG. 17 includes a toe cap 1700 coupled to the cord structure 66. The toe cap may be generally referred to as a support structure. In one example, the toe cap 1700 may enclose a portion of the cord structure 66. However, in other examples the cord structure 66 may be coupled to peripheral portions of the toe cap 1700. Thus in such an example, the toe cap interrupts the cord structure 66 and divide it into multiple distinct sections. The toe cap 1700 may be constructed out of a material having less flexibility than the cord structure, in one example. However, other toe cap characteristics have been contemplated. The footwear article 50 shown in FIG. 17 further includes a heel counter 1702. As shown, the heel counter 1702 extends along a length of the article towards a front end of the article. Additionally in the depicted example, the heel counter 1702 is positioned away from the toe cap 1700. However in other example, the heel counter and toe cap may be positioned adjacent to one another.

Figure 18:
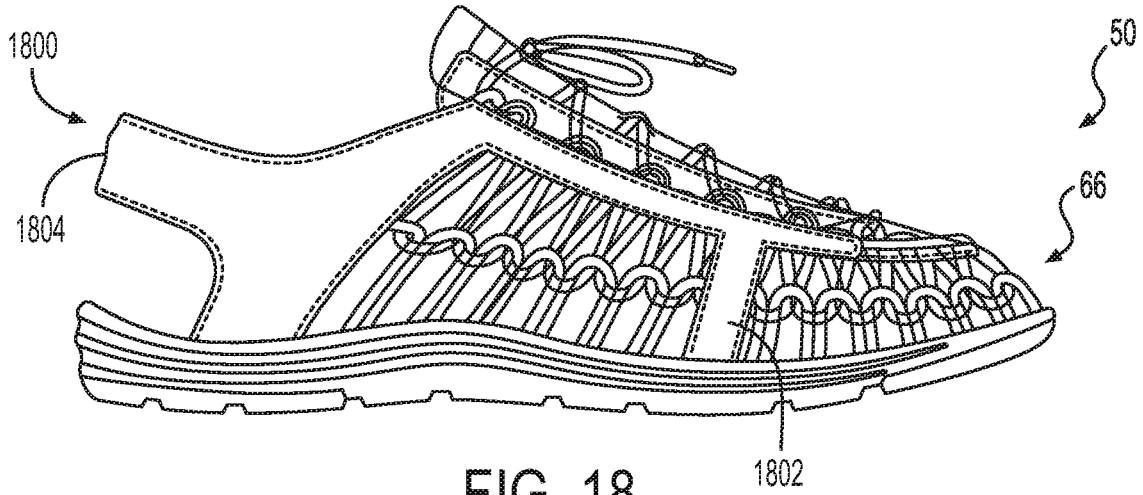

FIG. 18 shows another example footwear article 50. A support structure 1800 is shown included in the footwear article 50 in FIG. 18. The support structure 1800 extends around the heel and down the article towards the front of the article. The support structure 1800 further includes a portion extending from a top of the article toward the sole 52. The support structure 1800 shown in FIG. 18 is a continuous piece of material. However, it will be appreciated that the footwear article may include a plurality of support structures spaced away from one another, as shown in FIG. 17. In such an example each of the support structure may be formed from a separate continuous piece of material. The support structure 1800 includes a control strip 1802 and a heel section 1804. The control strip and the heel section provide controlled support to the structure 66. In this way, support may be provided to the cord structure 66 at desired locations.

Figure 19:
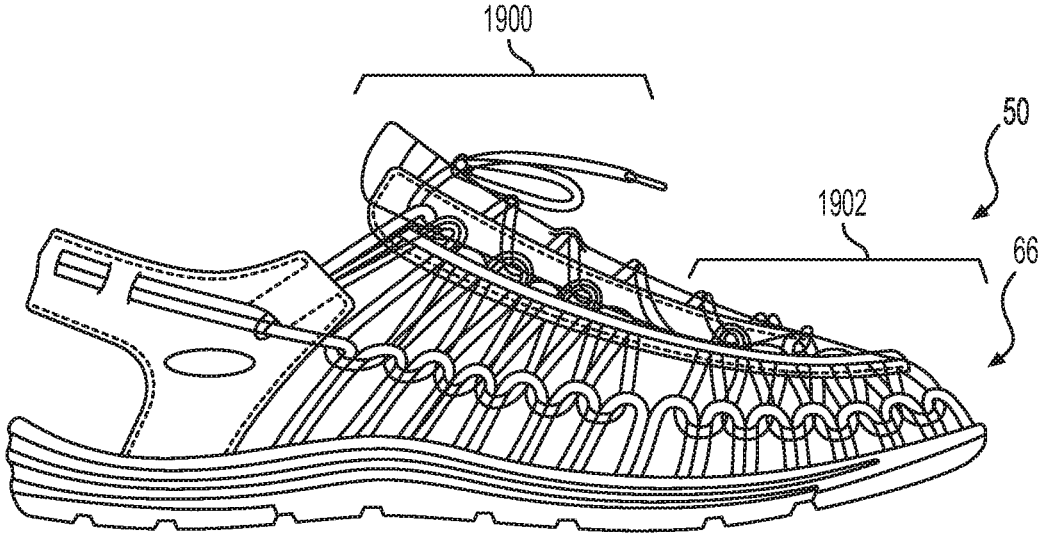

FIG. 19 shows another example footwear article 50. The cord structure 66 of the footwear article is illustrated. The cord structure 66 shown in FIG. 19 includes a first section 1900 and a second section 1902 spaced away from one another. The first section 1900 includes two or more cords and the second section 1902 includes two or more cords different from the cords in the first section.

The slippable engagement between cords in the sections of the cord structure 66 may vary between the sections. For instance, the cords in the second section 1902 may be partially-securely engaged at selected points and the cords in the first section 1900 may be slippably engaged at selected points or vice-versa. In this way, the cord structure may have varying degrees of compliance in different sections. As shown, the sections are longitudinally divided. However, alternate section boundaries have been contemplated. For instance, a first section may extend around an upper portion of the footwear article and a lower section may extend around a lower portion of the footwear article adjacent to the sole. It will be appreciated that the boundaries of the sections may be selected based on desired end use characteristics. In other examples, the cord structure may be divided into three or more sections. The variation in the degree of engagement between the cord structure sections enables desired regions of the footwear article to have greater degrees of movement than other regions of the footwear article. Thus, fitting characteristics of the footwear article may be selected for specified regions of the footwear article. As a result, fitting and comfort of the footwear article is improved. Further in another example, cords in the cord structure may only be intertwined in selected regions of the footwear article. For instance, a heel portion and a toe portion of the footwear article may not include intertwined cords and a section between the heel and toe portion may have intertwined cords.

FIG. 20 shows another example footwear article 50. As previously discussed, the footwear article includes the bootie 2000 which is at least partially enclosed by the cord structure 66. As discussed above, the cord structure may be attached to the bootie in one example. Additionally or alternatively, the bootie 2000 may be attached to the sole 52. The bootie may be attached to the heel counter 97, in one example. However in other example, the bootie 2000 may not be attached to the heel counter 97. The sole 52 is also depicted in FIG. 20. It will be appreciated that the footwear articles shown in FIGS. 16-20 may include a sole similar to the sole shown in FIG. 2.

Figure 21:
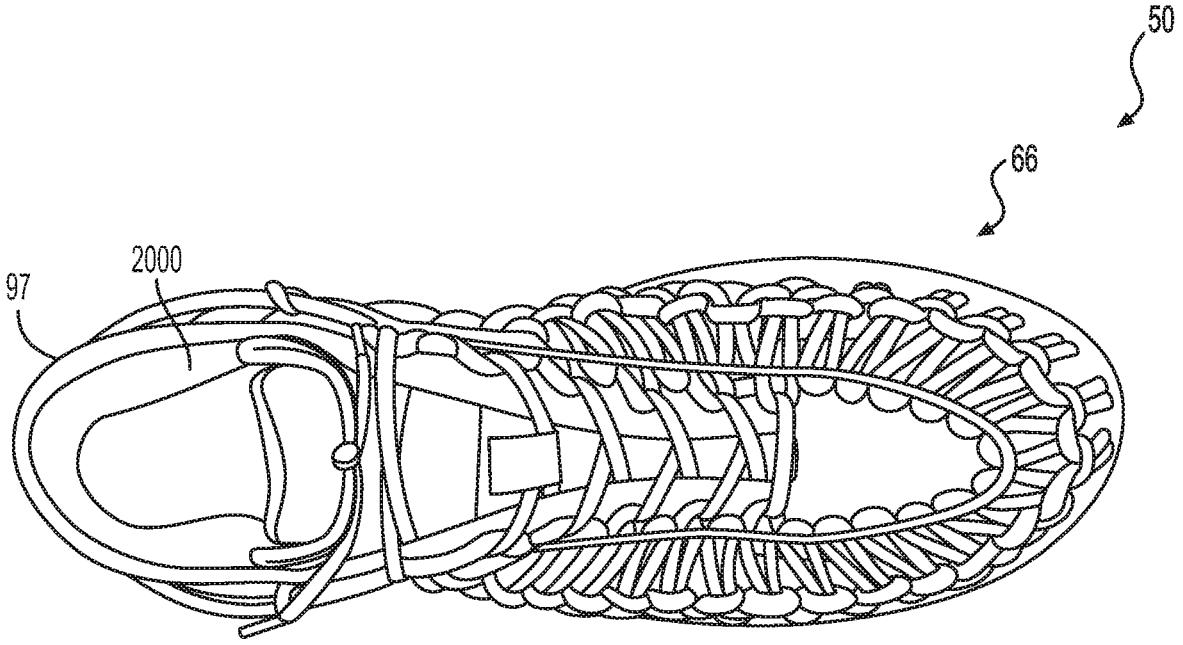

FIG. 21 shows a top view of the example footwear article 50 shown in FIG. 20. Again the bootie 2000 is depicted. The bootie 2000 is enclosed via the cord structure 66. In one example, the bootie 2000 may be attached (e.g., stitched, adhesively coupled, etc.) to portions of the cord structure 66. However in other example the bootie 2000 may not be attached to the cord structure 66. Additionally, the heel counter 97 is also depicted in FIG. 21. The heel counter 97 is coupled to the cord structure 66.

FIG. 22 shows a section of an example sole 52. The sole includes an opening 2200. The opening may be configured to receive a section 2202 of a cord included in the cord structure discussed above, that snaps into the opening 2200 as opposed to passing through the opening as shown in previous examples. Thus, the opening 2200 may retain the cord via an elastic force. It will be appreciated that a plurality of this type of "snap attachment" openings may be included in the sole 52.

FIG. 23 shows another example sole 52. The sole 52 includes a core section 2300 and an outer ring section 2302. The core section 2300 includes openings 2304. It will be appreciated that cords may be threaded through the openings 2304 during construction of the footwear article. Furthermore, the outer ring section 2302 may peripherally extend around the core section 2300. In some examples, the sole 52 may include a plurality of outer ring sections. However, in other examples, the sole may include a single outer ring section peripherally extending around the entire core section. The outer ring section 2302 and the core section 2300 may be adhesively bonded, sewn, or otherwise suitably attached to the core section 2300.

FIG. 24 shows another example sole 52. The sole includes a pin 2400 located in an opening 2401 on the sole 52. A cord 2402 included in the cord structure may extend around the pin. In this example, the cord passes through the opening 2401 twice. In this way, the cord may be attached to the sole through a single opening with limited slip. It will be appreciated that in one example pins may be included in a plurality of openings in the sole. Further in another example, a portion of the openings in the sole may include pins and another portion of the opening may not include pins.

It will be appreciated that the configurations and/or approaches described herein are exemplary in nature, and that these specific embodiments or examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

The invention claimed is:

1. A footwear article, comprising:

a sole having cord structure attachment openings; and a cord structure including a rand substructure formed by a first cord and a vamp substructure formed by a second cord, the first cord of the rand substructure forming sole attachment bights extending into the cord structure attachment openings coupling the sole to the rand substructure, the first cord of the rand substructure further forming vamp attachment bights interconnected with rand attachment bights formed by the vamp substructure, each vamp attachment bight directly looping through two rand attachment bights.

2. The footwear article of claim 1, where the vamp substructure is positioned away from the sole.

3. The footwear article of claim 1, where the rand substructure comprises one or more rand cords.

4. The footwear article of claim 1, where the vamp substructure comprises one or more vamp cords.

5. The footwear article of claim 1, where the cord structure further comprises a sole cord extending through the sole attachment bights.

6. The footwear article of claim 1, where cords in the cord structure interlock to provide slippable engagement.

7. The footwear article of claim 1, further comprising a heel counter coupled to the cord structure, wherein one or more cords in the cord structure extend through the heel counter.

8. The footwear article of claim 1, where the cord structure includes a first section and a second section having different degrees of slippable engagement.

9. The footwear article of claim 5, where the sole cord extends across the sole from a first side to a second side one or more times.

10. The footwear article of claim 1, wherein the cord structure further includes a lace cord interconnected with lace attachment bights formed by the second cord of the vamp substructure.

* * * * *